US005643042A

United States Patent [19]

Watkins

[11] Patent Number: 5,643,042

[45] Date of Patent: Jul. 1, 1997

[54] STACKED CONFETTI

[76] Inventor: James O. Watkins, 14920 Mt. Nebo Rd., Poolesville, Md. 20837

[21] Appl. No.: 413,095

[22] Filed: Mar. 29, 1995

Related U.S. Application Data

[63] Continuation-in-part of Ser. No. 80,534, Jun. 24, 1993, Pat. No. 5,403,225, which is a continuation of Ser. No. 51,355, Apr. 23, 1993, Pat. No. 5,352,148.

[51] Int. Cl.[6] ..... A63H 37/00

[52] U.S. Cl. ..... 446/475; 446/491

[58] Field of Search ..... 446/475, 34, 491; 40/216; 273/293, 294

[56] References Cited

U.S. PATENT DOCUMENTS

| | | | |
|---|---|---|---|
| 262,240 | 8/1882 | Newby | 40/216 |
| 585,805 | 7/1897 | Wilhelmi | 40/216 |
| 866,329 | 7/1907 | Archimbard | 40/216 |
| 1,034,402 | 7/1912 | Hardy . | |
| 1,286,178 | 11/1918 | Halsey | 40/216 |
| 1,615,947 | 2/1927 | Klapka | 40/216 |
| 1,879,894 | 9/1932 | Eshbaugh | 40/216 |
| 2,871,597 | 2/1959 | Yost | 40/216 |
| 2,932,469 | 4/1960 | Yost | 40/216 |
| 4,053,158 | 10/1977 | Breslow | 273/236 |

FOREIGN PATENT DOCUMENTS

| | | | |
|---|---|---|---|
| 458472 | 11/1928 | Germany | 446/491 |
| 341784 | 1/1931 | United Kingdom | 446/475 |

OTHER PUBLICATIONS

"Foster–House" Catalog, address label advirtisement, Christmas, 1976, p. 33.

Johnson Smith Co., "Things you never knew existed" received Dec. 31, 1992, p. 29.

*Primary Examiner*—Robert A. Hafer

*Assistant Examiner*—Jeffrey D. Carlson

*Attorney, Agent, or Firm*—Ronald B. Sherer

[57] ABSTRACT

A form of confetti is disclosed which comprises a plurality of pieces of paper, tissue paper or plastic film wherein each piece of confetti has an elongated tetragonal shape and the plurality of pieces of confetti are stacked in face-to-face relationship with their lengths parallel to each other so as to form an unwrapped stack of tetragonal-shaped confetti having a mass so as to be capable of being projected high into the air.

6 Claims, 2 Drawing Sheets

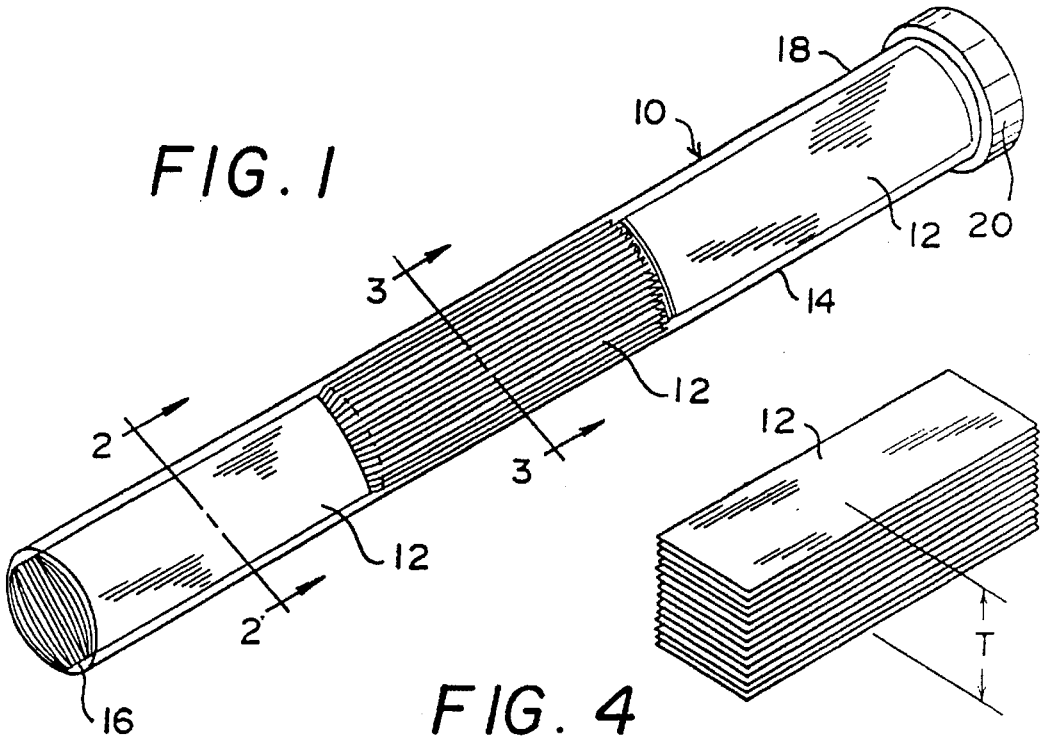
FIG. 1
FIG. 4
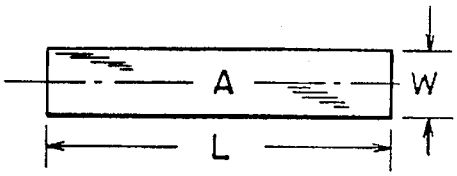
FIG. 5a
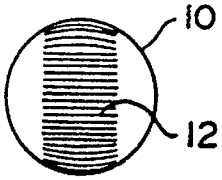
FIG. 2
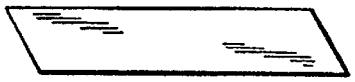
FIG. 5b
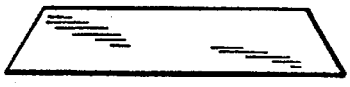
FIG. 5c
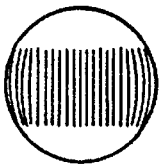
FIG. 3
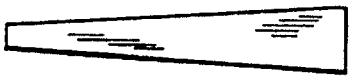
FIG. 5d
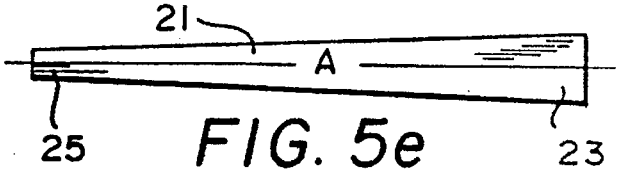
FIG. 5e FIG. 6
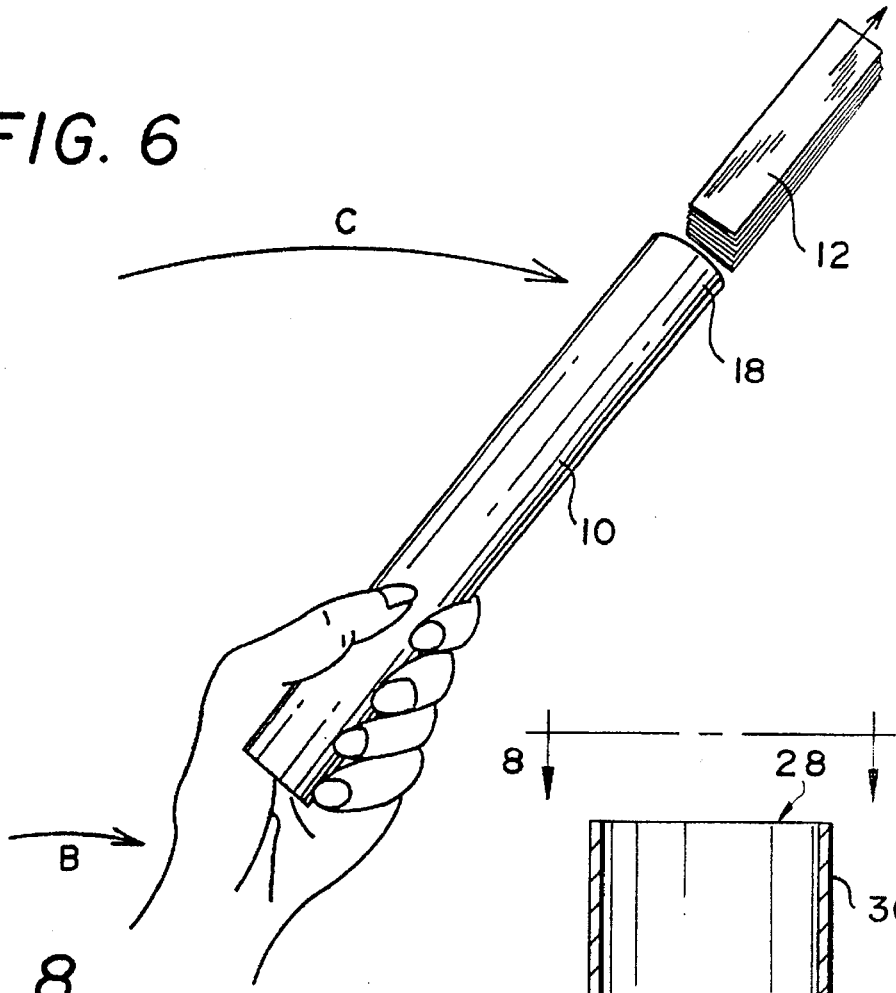
FIG. 8
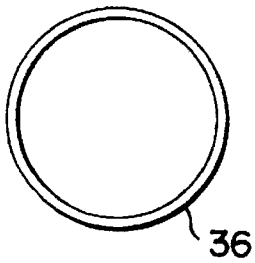
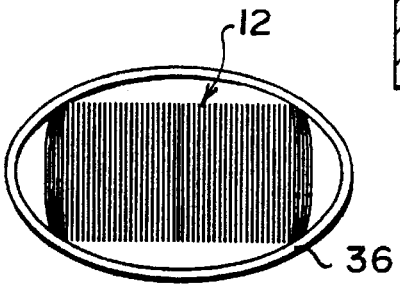
FIG. 9
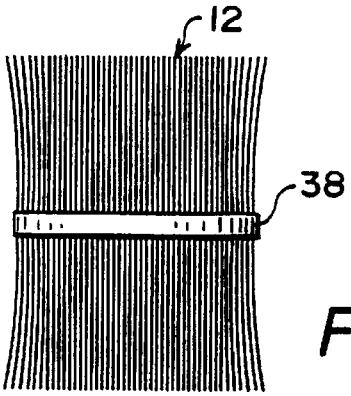
FIG. 10
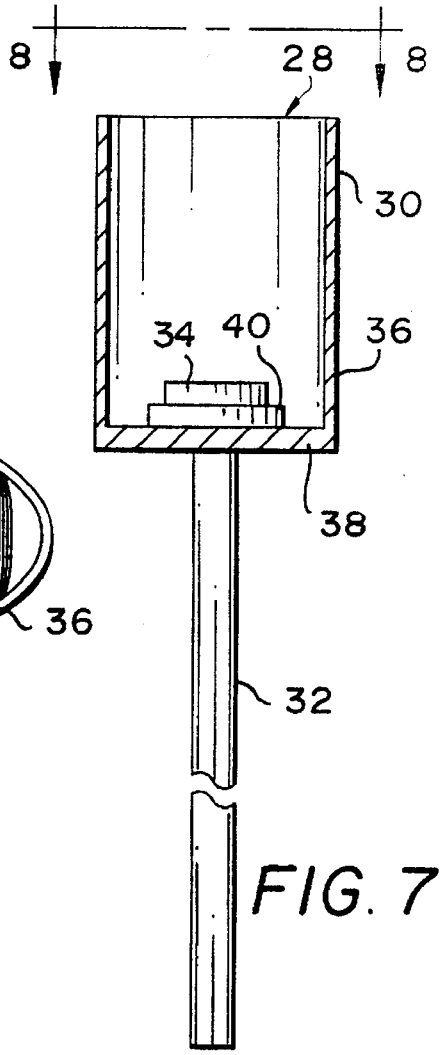
FIG. 7

STACKED CONFETTI

This application is a continuation-in-part of application Ser. No. 08/080,534 filed 24 June 1993, now U.S. Pat. No. 5,403,225 which was a continuation of application Ser. No. 08/051,355 filed 23 April 1993, now U.S. Pat. No. 5,352, 148, the complete disclosures of both Applications and Patents being hereby incorporated by reference.

FIELD OF THE INVENTION

This invention relates to amusement devices, and more particularly to launching confetti into the air. More specifically, the present invention relates to stacked confetti, and to tubes or wands filled with stacks of confetti which propel the stacked confetti into the air by centrifugal force when the tube or wand is waved forwardly with the arm and with a flick of the wrist motion.

BACKGROUND

Many prior devices have been designed for propelling confetti into the air, but each has had its particular disadvantages. For example, so-called "cannons" or "bombs" have been devised, as described for example in U.S. Pat. Nos. 825,843 and 1,663,679, in which a charge of explosive material is ignited to cause an explosion which drives randomly packed, small round or square pieces of confetti into the air in a generally cloud-like pattern. In addition to not being able to propel the individual pieces of confetti very high into the air, unless large explosive charges are used, the hazard of using any explosive charge is apparent.

Another prior type of device is illustrated in U.S. Pat. Nos. 1,153,207 and 1,491,809 in which horn-shaped devices are filled with randomly packed, small round or square pieces of confetti, and a mouth piece is provided at the small end of the horn for blowing the confetti out of the horn by the breath of the user. Such devices are safe, but the amount of force available to expel the confetti is quite limited such that the confetti is not propelled into the air very high or far. Also, the small, random-packed pieces of confetti exit the horn as a cloud rather than rise in the air and then burst into individual pieces.

It is also known to expel confetti from so-called "cannons" by the use of compressed air or CO2 charges, and such cannons are effective at professionally conducted shows where sources of compressed air or CO2 are available. However, such devices are not highly portable, since the cannon must remain connected to the gas source by a flexible hose, or the cannon must include a CO2 cartridge as taught, for example in U.S. Pat. No. 5,015,211. Such cannons are packed with loose, random oriented pieces of confetti which exit the cannon as a cloud of confetti pieces and the pattern is highly unpredictable.

SUMMARY

The present invention solves all of the above-indicated problems by providing confetti in unwrapped stacks with an extremely simple and safe device whereby children and adults, as well as professionals, may propel confetti high into the air so as to obtain dramatic visual effects. In the present invention, the confetti is in the form of unwrapped stacks of confetti pieces such that the stacks burst into hundreds or thousands of individual pieces of confetti. The individual confetti pieces have elongated tetragonal shapes, which will be more fully described hereafter, such that they fall slowly to the ground with floating, fluttering, darting and twirling motions.

In one embodiment, the invention includes a hollow tube or wand which contains stacks of confetti and which has an open end such that, when the tube or wand is waved forwardly with the forearm and with a flick of the wrist motion, the confetti stacks are propelled out of the tube or wand by centrifugal force and are propelled high in the air where the stacks burst and the individual pieces of confetti flutter down slowly in a dramatic display of color and motion.

These and other objects and advantages will become apparent from the following description of several illustrative embodiments of the invention as shown in the following illustrative drawings.

BRIEF DESCRIPTION OF DRAWINGS

FIG. 1 is a perspective view of a clear plastic tube containing several unwrapped stacks of elongated rectangularly shaped confetti;

FIGS. 2 and 3 are cross-sectional views taken along lines 2—2 and 3—3 of FIG. 1;

FIG. 4 is a perspective view of one unwrapped stack of confetti;

FIGS. 5*a–e* are plan views of five individual pieces of elongated tetragonal shaped confetti;

FIG. 6 is a perspective view of the tube of FIG. 1 in the hand of a user propelling a stack of confetti into the air;

FIG. 7 is a side view, partly in cross-section, of a wand having a cup portion and a handle portion;

FIG. 8 is a sectional view taken along line 8—8 of FIG. 7;

FIG. 9 is a sectional view taken along the same line showing the cup containing a stack of unwrapped confetti; and FIG. 10 is a side view of an unwrapped stack of confetti secured for shipment by a rubber band.

DETAILED DESCRIPTION

Referring to FIG. 1, numeral 10 designates an elongated, hollow tube which may be composed of plastic, metal, cardboard or any other material which may be formed into a rigid tube with a relatively smooth interior surface. In the particular embodiment illustrated in FIG. 1, tube 10 is shown as being formed of clear plastic so that the unwrapped stacks 12 of confetti inside the tube may be seen through the cylindrical wall 14 of the tube; however, the tube may be opaque and colored if desired. Stack 12 preferably comprises several hundred pieces of elongated tetragonal shaped confetti as described application Ser. No. 08/080,534, now U.S. Pat. No. 5,403,225, the complete disclosure which is incorporated by reference herein, and as will be more fully described hereafter.

As further shown in FIG. 1, the lower end of tube 10 is formed with a closed end 16 which may be formed integral with the tube wall 14, or may be formed by a permanent or removable plug or cap. The upper end 18 of the tube is open and is selectively closed by a removable cap 20. In the embodiment of FIGS. 1–3, the length of tube 10 is preferably in the order of about 6 to 18 inches so as to be easily handled by non-professionals including children. The diameter of tube 10, and particularly the inner diameter or I.D., may vary widely depending upon how many pieces of confetti are to be contained. However, it has been found that the best results are obtained with internal diameters of ½ inch or greater, so that there is a sufficient mass of confetti to eject forcefully, and preferably in the range of ½ to 2 inches, and most preferably in the range of ¾ to 1½ inches.

Referring to stacks 12 of confetti, each piece of confetti is preferably of elongated tetragonal shape as shown in FIGS. 5*a–e*. The particular shape of the pieces of confetti may vary from the right-angle rectangle shown in FIG. 5*a* and may include a parallelogram, trapezoid or truncated triangle as illustrated in FIGS. 5*b–e*. Each piece is preferably cut from lightweight material such as paper, tissue paper, or plastic film such as Mylar or PVC film, and is preferably colored and/or shiny; fireproof, biodegradable, colored tissue paper being one preferred material. Each piece has a length L and width W, and a longitudinal axis A. For example, the lengths of pieces in FIGS. 5*a* to 5*c* may be in the order of 1 to 4 inches, preferably 1.75 to 2.5 inches, and widths of ¼ to 1 inch and preferably 5/16 to ¾ inches. For maximum fluttering effect when falling, it has been discovered that, within these ranges of length and width, the optimum L/W ratio should be in the order of 1.5 to 4. Such four-sided pieces are referred to herein as "elongated tetragonal" shapes, and the shapes illustrated in FIGS. 5*a–c* do not fall to the ground with either a side or an end leading in the direction of fall. Rather, such elongated tetragonal pieces of confetti fall with their longitudinal axis A substantially parallel to the ground; i.e., substantially horizontally, while each piece rotates about its axis A. Due to the rotating or fluttering action, the pieces fall relatively slowly, and with a horizontal component of movement such that each has a relatively long "hang" time while it flutters to the ground; such hang time being in the order of four to five times that of conventional prior art confetti.

Referring to FIG. 5*d*, this piece of confetti is in the shape of a truncated triangle with opposite longitudinal ends of unequal width. The length of this piece is preferably in the order of 2.25 to 3.5 inches, and more preferably in the order of 2.75 to 3.25 inches. The width of the narrow end is preferably in the order of 1/16 to ¼ inches, and more preferably in the order of ⅛ to 3/16 inches. The width of the wide end is preferably in the order of 0.5 to 1 inch, and more preferably in the order of 0.6 to 0.8 inches. Within these ranges of length and width, it has been discovered that the preferred L/W ratio should be in the order of 2.75 to 6, and the optimum L/W ratio should be in the order of 3 to 5; the L/W ratio being determined with respect to the wider end. Although the piece of confetti of FIG. 5*c* is also an elongated tetragonal shape, this truncated triangular shape having the above-indicated dimensions falls with its longitudinal axis at substantially 45° with respect to the horizontal, and rotates about such axis, and also darts sideways as it slowly floats downwardly.

Referring to FIG. 5*e*, a piece of elongated tetragonal confetti 21 is illustrated which has an entirely different falling motion than that described with respect to FIGS. 5*a–d*. Confetti piece 21 is in the form of an elongated, truncated triangle having a length in the order of 3–6 inches, and preferably 3.5 to 4.25 inches. The width of end 25 may be in the order of 1/32 to ¼ of an inch while end 23 may be in the order of ½ to 1 inch. This forms a relatively longer and proportionately narrower truncated triangle than that shown in FIG. 5*d*.

When piece 21 falls through the air, it falls with the narrow end 25 leading in the direction of fall with the piece rotating about axis A which extends vertically instead of horizontally. As piece 21 falls in this vertical orientation, the ends 23 and 25 tend to flutter laterally relative to the midportion such that the motion is that of a corkscrew twirling to the ground. In addition to fluttering vertically instead of horizontally, confetti pieces in the shape described with respect to FIG. 5*e* fall faster than those described with respect to FIGS. 5*a–d*. Thus, when these three types of elongated tetragonal shapes are released in the air together, there is the unique visual effect of some pieces fluttering horizontally and falling relatively slowly, while others dart sideways, and others twirl vertically and fall more rapidly through the mass of more slowly falling pieces.

Referring to FIGS. 1–4, each of stacks 12 is an unwrapped stack containing a hundred or more, and preferably 200–800, aligned pieces of elongated tetragonal confetti; such tetragonal confetti being known under the trademark FLUTTER FETTI confetti. One or more of stacks 12 is slid into the tube from open end 18 and, while all of the stacks may be slid into the tube with the layers of FLUTTER FETTI confetti oriented in parallel planes, it is preferred that the layers of the stacks be oriented at an angle with respect to each other as illustrated in FIGS. 1–3. This angled orientation of the layers prevents pieces from one stack from shifting into the adjacent stack and thereby keeps each stack intact until it is launched as well as during launch.

OPERATION

If tube 10 is pre-loaded with one or more stacks 12 of confetti, a removable cap 20 is put on the tube to close open end 18 for shipment and storage until use. Alternatively, the tube may be sold empty and the user may load it with the desired number of stacks of confetti. When it is desired to use the tube, the lower portion of the tube is held in the hand as illustrated in FIG. 6, and cap 20 is removed if it is present. The forearm is first pulled back, and then waved forward in a rapid motion, along with a forward flicking of the wrist, as represented by arrow B, such that tube 10 is moved through an arcuate path as represented by arrow C. This arcuate movement produces a centrifugal force acting on the confetti stacks 12 such that they are rapidly propelled out of the open end of the tube as shown in FIG. 6.

It should be noted that stacks 12 do not immediately separate into individual pieces of confetti at the instant of leaving the open end 18 of tube 20 as is the case with random or loose-packed confetti. While the reasons are not fully known, and such reasons form no part of the present invention, there is a distinct tendency of the stacks 12 of the present invention, even though they are unwrapped, to remain substantially intact as they are ejected from the tube, and at least major portions of most stacks continue to remain intact as they rise into the air. Of course, some of the individual pieces of confetti separate from the stack as each stack flies upwardly in the air. However, whether due to static electricity, humidity, compression of the stacks in the tube or other factors, significant portions of the stacks tend to remain together and reach heights of 15–20 feet or more in the air before the remaining portions of the stacks burst into hundreds of pieces. Once having reached their maximum height, the hundreds of pieces of confetti then begin their relatively slow, floating descent as each piece rotates horizontally about its longitudinal axis thereby producing a unique fluttering motion. In addition, if pieces shaped as described with reference to FIG. 5*d* are present, they dart sideways, while pieces of the shape described with reference to FIG. 5*e* spiral and twirl vertically as they fall at a faster rate through the other pieces.

Referring to FIGS. 7–9, a wand 28 is illustrated which includes a hollow tubular or cup portion 30 attached to a handle portion 32 by a screw or bolt 34. Cup portion includes an annular wall 36 and an integral base 38 the latter of which may be reinforced by a washer 40. Cup portion 30 is preferably comprised of flexible, deformable material such as for example, rubber, vinyl, or plastic or rubber foam material such that its normal circular cross-section, as shown in FIG. 8, may be readily deformed into an oval or elliptical shape, as shown in FIG. 9, when a stack of confetti 12 is forced downwardly into the cup portion. Of course, it is to be understood that other shapes and constructions of wands are possible, such as those disclosed in application Ser. No. 08/368,500, now U.S. Pat. No. 5,556,319, the complete disclosure of which is hereby incorporated by reference.

In use, the wand is grasped by handle 32 and with the same movement of the forearm and wrist previously described cup portion 30 is moved rapidly in an arcuate path whereby centrifugal force acts on the effective mass of the unwrapped stack of confetti pieces, and the stack is propelled out of the cup upwardly into the air where it may easily reach heights of 25 feet and greater.

From the foregoing description it will be appreciated that, although conventional confetti of random shape and loose or bulk random orientation has no effective mass and cannot be thrown more than a few feet into the air by hand, the present invention provides for the easy launching of hundreds of pieces of confetti many feet into the air; ie, such as 25 feet and more into the air. This is made possible by the fact that the elongated tetragonal pieces are stacked together; ie, in face-to-face relationship, and with their longitudinal axes parallel to each other, so as to form a concentrated and effective mass when launched, and which stack remains an effective mass as the stack rises in the air even though the stack is not wrapped or otherwise secured together.

For use in the hollow tube of the FIG. 1 embodiment, it has been determined that the thickness T of the stack as shown in FIG. 4 should be in the order of ½ inch or greater, and preferably of ¾ of an inch or greater, in order to have the preferred amount of effective mass. In the case of the wand, or when stacks are to be launched out of compressed air or $CO_2$ cannons, it has been determined that the thickness T should be ¾ inch or greater, and may be up to 2 inches without becoming too large or massive to be launched by the average person. It has also been determined that, for purposes of ease and economics of manufacture, as well as shipment and ease of use by the ultimate user, a preferred method is to cut and form the stacks of the preferred thicknesses indicated above. Then, as shown in FIG. 10, a rubber band 38 is slipped about the stack, and the banded stacks may be boxed or bagged for shipment and sale to the users. The user simply removes the rubber band and loads the unwrapped stack into the launching device from which it may be easily launched as previously described.

Of course, it will be readily apparent to those skilled in the art that many other embodiments and variations may be designed based upon the principles of the present invention. Therefore, it is to be understood that the foregoing description of several embodiments is purely illustrative rather than limiting of the invention, and that the legal scope of the invention is not to be limited other than as set forth in the following claims as interpreted under the doctrine of equivalents.

What is claimed is:

1. An unwrapped stack of confetti comprising:

(a) a plurality of at least 100 individual, unconnected pieces of confetti;

(b) each of said individual pieces of confetti being of the same shape and substantially the same size;

(c) each of said plurality of individual pieces of confetti consisting of a single layer of tissue paper;

(d) each of said individual pieces of tissue paper confetti having an elongated tetragonal shape;

(e) each of said individual pieces of confetti having a width and a length, said length being greater than said width;

(f) said lengths being in the order of 1 to 4 inches and said widths being in the order of ¼ to 1 inch;

(g) each of said individual pieces of confetti having a central axis extending along its length and a pair of faces;

(h) said plurality of individual pieces of confetti being stacked together in face-to-face relationship to form an unconnected stack with said lengths aligned parallel to each other to form an aligned, unwrapped stack of tetragonal-shaped confetti, said stack comprising a concentrated mass for projection high into the air and for bursting in the air into individual pieces of confetti each of which pieces rotates about said axis and floats slowly downwardly.

2. The unwrapped stack of confetti of claim 1 further including the ratio of said lengths to widths being in the order of 1.5 to 4.

3. The unwrapped stack of confetti of claim 1 wherein said lengths are in the order of 1.75 to 2.5 inches, and said widths are in the order of 5/16 to ¾ inches.

4. An unwrapped stack of confetti comprising;

(a) a plurality of at least 100 individual, unconnected pieces of confetti;

(b) each of said individual pieces of confetti being of the same shape and substantially the same size;

(c) each of said plurality of individual pieces of confetti consisting of a single layer of tissue paper;

(d) each of said individual pieces of tissue paper confetti having an elongated tetragonal shape;

(e) each of said individual pieces of confetti having a width and a length, said length being greater than said width;

(f) said lengths being in the order of 1 to 4 inches and said widths being in the order of ¼ to 1 inch and the length to width ratio being in the order of 1.5 to 4;

(g) each of said individual pieces of confetti having a central axis extending along its length and a pair of faces;

(h) said large plurality of individual pieces of confetti being stacked together in face-to-face relationship to form an unconnected stack with said lengths aligned parallel to each other to form an aligned, unwrapped stack of tetragonal-shaped confetti, said stack comprising a concentrated mass for projection high into the air and for bursting in the air into individual pieces of confetti each of which pieces rotates about said axis and floats slowly downwardly.

5. The unwrapped stack of confetti of claim 4 wherein said lengths are in the order of 1.75 to 2.5 inches.

6. The unwrapped stack of confetti of claim 4 wherein said widths are in the order of 5/16 to ¾ inches.

* * * * *

US005643042B1

(12) REEXAMINATION CERTIFICATE (4459th)

United States Patent

Watkins

(10) Number: US 5,643,042 C1

(45) Certificate Issued: Oct. 16, 2001

(54) STACKED CONFETTI

(75) Inventor: James O. Watkins, 14920 Mt. Nebo Rd., Poolesville, MD (US) 20837

(73) Assignee: James O. Watkins, Poolesville, MD (US)

Reexamination Request:
No. 90/005,103, Sep. 25, 1998

Reexamination Certificate for:

| | |
|---|---|
| Patent No.: | **5,643,042** |
| Issued: | **Jul. 1, 1997** |
| Appl. No.: | **08/413,095** |
| Filed: | **Mar. 29, 1995** |

Related U.S. Application Data

(63) Continuation-in-part of application No. 08/080,534, filed on Jun. 24, 1993, now Pat. No. 5,403,225, which is a continuation of application No. 08/051,355, filed on Apr. 23, 1993, now Pat. No. 5,352,148.

(51) Int. Cl.[7] ..... A63H 37/00

(52) U.S. Cl. ..... 446/475; 446/491

(58) Field of Search ..... 40/216; 273/293, 273/294; 446/34, 475, 491

(56) References Cited

U.S. PATENT DOCUMENTS

| | | | | |
|---|---|---|---|---|
| 3,204,817 | * | 9/1965 | Kostering | 221/210 |
| 3,950,123 | * | 4/1976 | Louie | 425/500 |
| 4,417,670 | * | 11/1983 | Bodher | 221/210 |

* cited by examiner

*Primary Examiner*—John A. Ricci

(57) ABSTRACT

A form of confetti is disclosed which comprises a plurality of pieces of paper, tissue paper or plastic film wherein each piece of confetti has an elongated tetragonal shape and the plurality of pieces of confetti are stacked in face-to-face relationship with their lengths parallel to each other so as to form an unwrapped stack of tetragonal-shaped confetti having a mass so as to be capable of being projected high into the air.

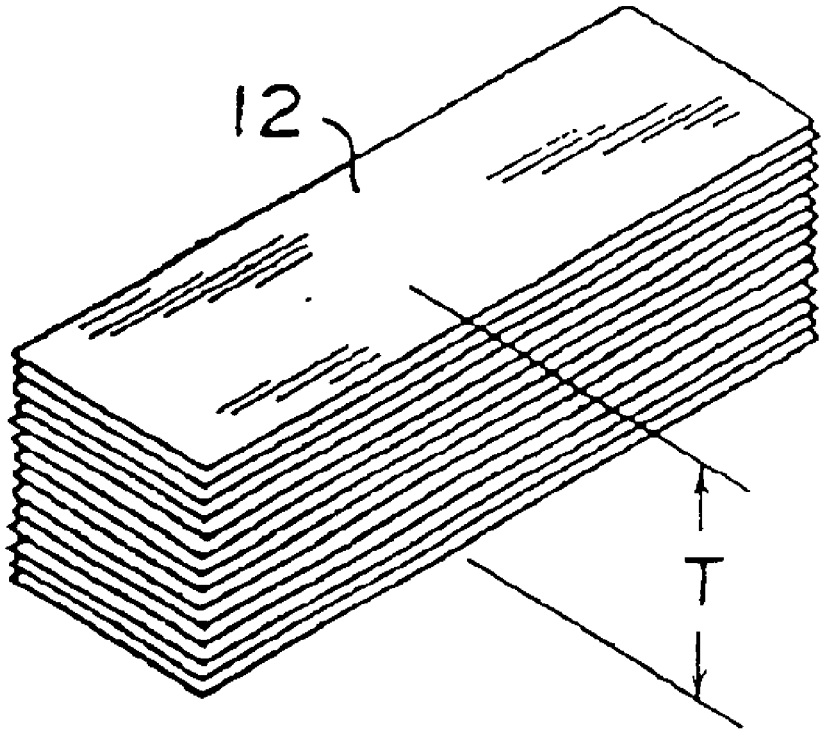

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–6 is confirmed.

New claim 7 is added and determined to be patentable.

*7. An unwrapped stack of confetti comprising:*

(*a*) *a plurality of at least 100 individual, unconnected and uncontained pieces of confetti;*

(*b*) *each of said individual pieces of confetti being of the same shape and substantially the same size;*

(*c*) *each of said plurality of individual pieces of confetti consisting of a single layer of tissue paper;*

(*d*) *each of said individual pieces of tissue paper confetti having an elongated tetragonal shape;*

(*e*) *each of said individual pieces of confetti having a width and a length, said length being greater than said width;*

(*f*) *said lengths being in order of 1 to 4 inches and said widths being in order of ¼ to 1 inch;*

(*g*) *each of said individual pieces of confetti having a central axis extending along its length and a pair of faces;*

(*h*) *said plurality of individual pieces of confetti being stacked together in face-to-face relationship to form an unconnected stack with said lengths aligned parallel to each other to form an aligned, unwrapped stack of tetragonal-shaped confetti, said stack comprising a concentrated mass for projection high into the air and for bursting in the air into individual pieces of confetti each of which pieces rotates about said axis and floats slowly downwardly.*

* * * * *